US005460353A

United States Patent [19]

Rittenhouse

[11] Patent Number: 5,460,353

[45] Date of Patent: Oct. 24, 1995

[54] PORTABLE FENCE WITH WATER FILLED BASES

[76] Inventor: Michael R. Rittenhouse, 121 Fitchburg Dr., Woodstock, Ga. 30188

[21] Appl. No.: 251,197

[22] Filed: May 31, 1994

[51] Int. Cl.[6] ..... A63B 69/00; E04H 17/00

[52] U.S. Cl. ..... 256/1; 256/24; 256/64; 40/607; 160/135; 160/351; 248/519; 248/910; 472/94

[58] Field of Search ..... 256/1, 64, 24; 404/6; 40/606, 607; 160/135, 351; 248/910, 530, 519; 472/94

[56] References Cited

U.S. PATENT DOCUMENTS

| | | | |
|---|---|---|---|
| 3,119,588 | 1/1964 | Keats | 256/64 X |
| 3,767,167 | 10/1973 | Rasmussen | 256/26 |
| 3,770,246 | 11/1973 | Key | 256/25 |
| 3,789,801 | 2/1974 | Moreng | 256/24 X |
| 4,105,190 | 8/1978 | Curtis | 256/1 |
| 4,145,031 | 3/1979 | Baker, II | 256/65 |
| 4,145,044 | 3/1979 | Wilson et al. | 248/519 X |
| 5,042,557 | 8/1991 | Norsworthy | 160/351 |
| 5,259,612 | 11/1993 | Matherne et al. | 248/910 X |
| 5,402,999 | 4/1995 | Keehn, Sr. | 160/135 X |

FOREIGN PATENT DOCUMENTS

| | | | |
|---|---|---|---|
| 994741 | 8/1976 | Canada | 248/910 |
| 1922655 | 11/1970 | Germany | 256/64 |
| 391977 | 9/1965 | Switzerland | 248/519 |

*Primary Examiner*—Randolph A. Reese
*Assistant Examiner*—Christopher J. Novosad

[57] ABSTRACT

A plurality of corner posts positionable in a rectangular array, each corner post including a cylindrical tube positionable in a vertical orientation, each tube having a lower end and an upper end with a cap with a closed top positionable over the upper end and an extension member positioned over the lower end, the extension member being cylindrical in configuration with an internal shoulder adapted to receive thereagainst the lower end of the tube, the upper cap and lower extension member being formed with outwardly extending rings adapted to support corners of a screen, the lower end of the extension being formed with upwardly extending recesses for forming spring urged tangs therebetween; and a plurality of bases, each base adapted to receive the lower end of the extension member and positionable in a rectangular array beneath the posts and extension members, each base including a planar lower surface and a generally hemispherical upper surface with a vertical recess formed to extend downwardly from the upper surface for the receipt of the lower end of the extension member, the lower end of the extension member being formed with an annular projection with the lower end of the recess being formed with an annular groove for receiving the annular projection, and a threaded aperture with a threaded plug formed in the hemispherical portion of the base for filling the base with water during operation and use, and a plurality of apertures extending through the base constituting an annular flange.

4 Claims, 3 Drawing Sheets

FIG. 1
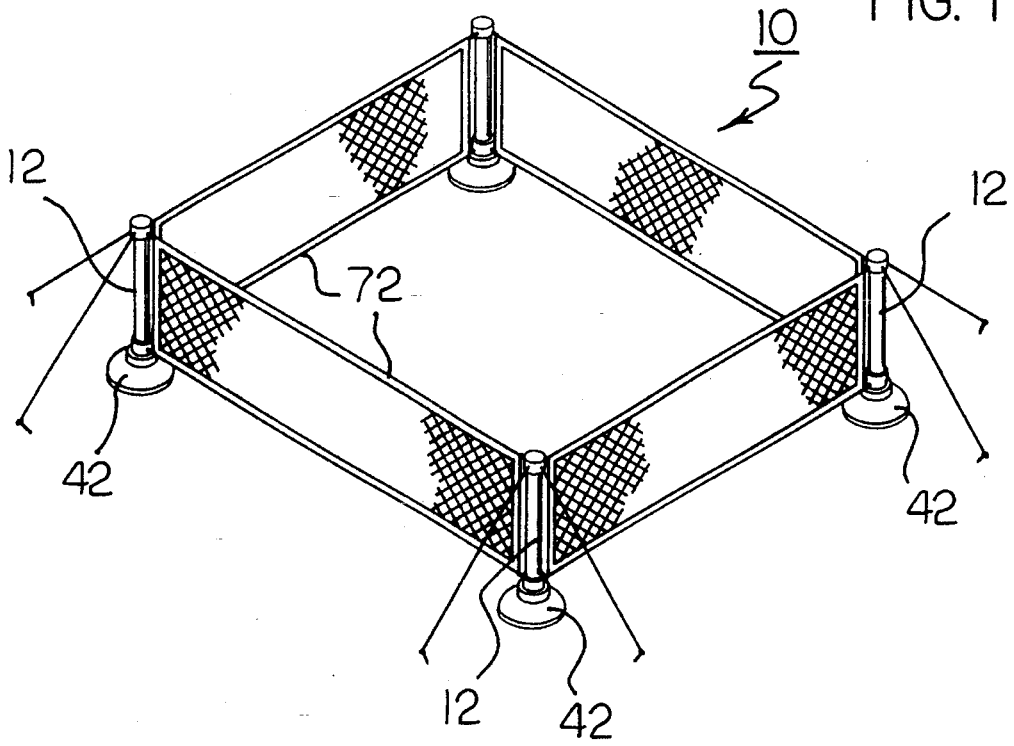
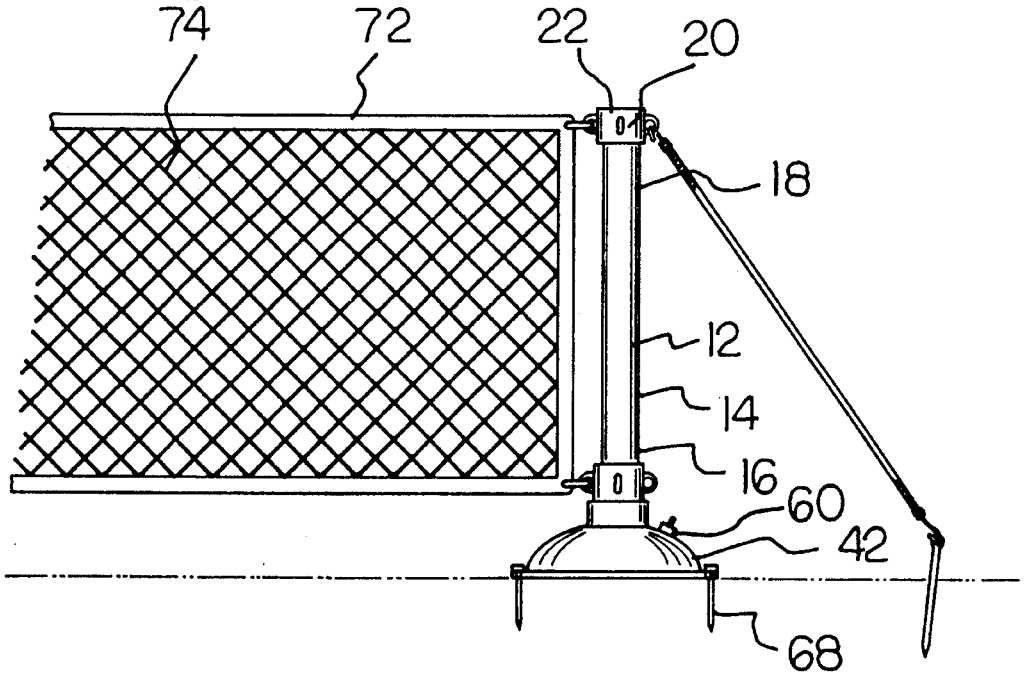
FIG. 2

PORTABLE FENCE WITH WATER FILLED BASES

BACKGROUND OF THE INVENTION

1. Field of the Invention

The present invention relates to a portable fence with water filled bases and more particularly pertains to creating a fenced in zone with lightweight components having water filled bases at the corners.

2. Description of the Prior Art

The use of fences including portable fences is known in the prior art. More specifically, fences including portable fences heretofore devised and utilized for the purpose of fencing in areas through a wide variety of arrangements, materials, components et cetera are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,042,557 to Norsworthy a portable fence system.

U.S. Pat. No. 4,145,031 to Baker discloses a modular dismanatleable fence.

U.S. Pat. No. 3,789,801 to Moreng discloses a portable collapsible steeplechase hurdle of fence.

U.S. Pat. No. 3,770,246 to Key discloses a modular, unitary sectional portable fence.

U.S. Pat. No. 3,767,167 to Rasmussen discloses a portable fence panel.

In this respect, the portable fence with water filled bases according to the present invention substantially departs from the conventional concepts and designs of the prior art, and in doing so provides an apparatus primarily developed for the purpose of creating a fenced in zone with lightweight components including water filled bases at the corners.

Therefore, it can be appreciated that there exists a continuing need for new and improved portable fence with water filled bases which can be used for creating a fenced in zone with lightweight components including water filled bases at the corners. In this regard, the present invention substantially fulfills this need.

SUMMARY OF THE INVENTION

In view of the foregoing disadvantages inherent in the known types of fences including portable fences now present in the prior art, the present invention provides an improved portable fence with water filled bases. As such, the general purpose of the present invention, which will be described subsequently in greater detail, is to provide a new and improved portable fence with water filled bases and method which has all the advantages of the prior art and none of the disadvantages.

To attain this, the present invention essentially comprises a plurality of corner posts positionable in a rectangular array, each corner post including a cylindrical tube positionable in a vertical orientation, each tube having a lower end and an upper end with a cap with a closed top positionable over the upper end and an extension member positioned over the lower end, the extension member being cylindrical in configuration with an internal shoulder adapted to receive thereagainst the lower end of the tube, the upper cap and lower extension member being formed with outwardly extending rings adapted to support corners of a screen, the lower end of the extension being formed with upwardly extending recesses for forming spring urged tangs therebetween; a plurality of bases, each base adapted to receive the lower end of the extension member and positionable in a rectangular array beneath the posts and extension members, each base including a planar lower surface and a generally hemispherical upper surface with a vertical recess formed to extend downwardly from the upper surface for the receipt of the lower end of the extension member, the lower end of the extension member being formed with an annular projection with the lower end of the recess being formed with an annular groove for receiving the annular projection for the secure coupling therebetween, and a threaded aperture with a threaded plug formed in the hemispherical portion of the base for filling the base with water during operation and use, and a plurality of apertures extending through the base constituting an annular flange formed as an extension of the lower surface for receiving anchor pins for greater securement of the bases and posts with respect to the ground; a plurality of rectangular fence panels, each fence panel being formed of a flexible plastic fencing material with rectangular apertures therethrough and with a plurality of circular grommets formed integrally with the periphery thereof, and a plastic edging around the periphery of the fence on opposite sides of the fence material, the posts; the posts, extension members, bases and mesh material being fabricated of a lightweight plastic material; and a fastener formed in each corner of each panel for removably coupling with the apertures in the panels and the rings of each tube.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable fence with water filled bases which have all the advantages of the prior art fences including portable fences and none of the disadvantages.

It is another object of the present invention to provide a new and improved portable fence with water filled bases which may be easily and efficiently manufactured and marketed.

It is further object of the present invention to provide a new and improved portable fence with water filled bases which are of durable and reliable constructions.

An even further object of the present invention is to provide a new and improved portable fence with water filled bases which are susceptible of a low cost of manufacture with regard to both materials and labor, and which accordingly are then susceptible of low prices of sale to the consuming public, thereby making such portable fence with water filled bases economically available to the buying public.

Still yet another object of the present invention is to provide a new and improved portable fence with water filled bases which provide in the apparatuses and methods of the prior art some of the advantages thereof, while simultaneously overcoming some of the disadvantages normally associated therewith.

Still another object of the present invention is to creating a fenced in zone with lightweight components including water filled bases at the corners.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved portable fence with water filled bases constructed in accordance with the principles of the present invention.

FIG. 2 is a front elevational view of one corner of the fence shown in FIG. 1.

The same reference numerals refer to the same parts through the various Figures.

DESCRIPTION OF THE PREFERRED EMBODIMENT

Figure 3:
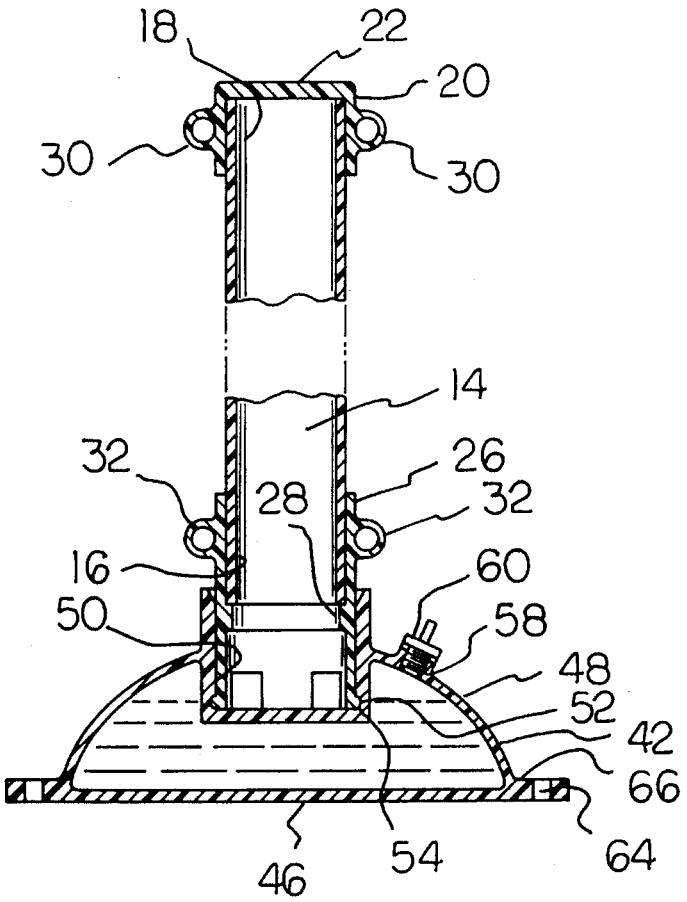
FIG. 3 is an enlarged cross-sectional view of one of the posts used at the corner of the fence as shown in the prior figure.
Figure 4:
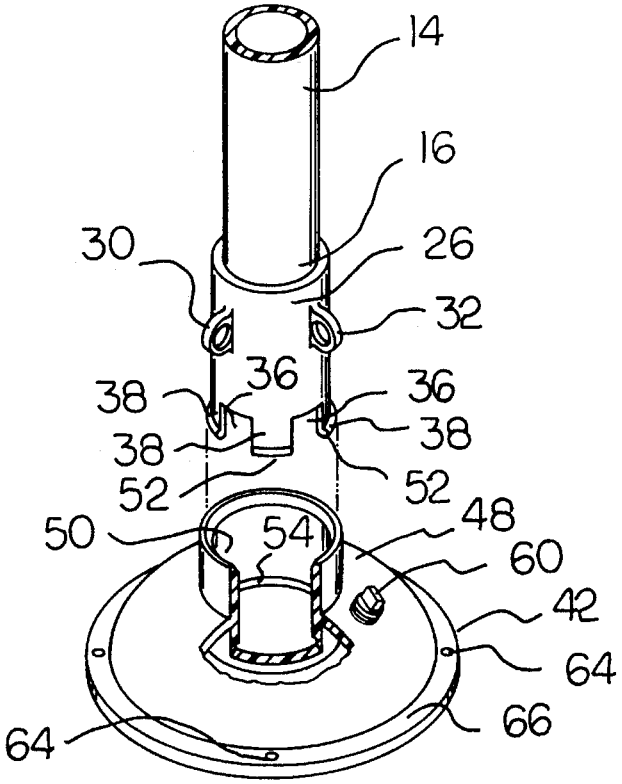
FIG. 4 is an exploded perspective view of the lower region of the posts shown in FIGS. 1, 2 and 3.
Figure 5:
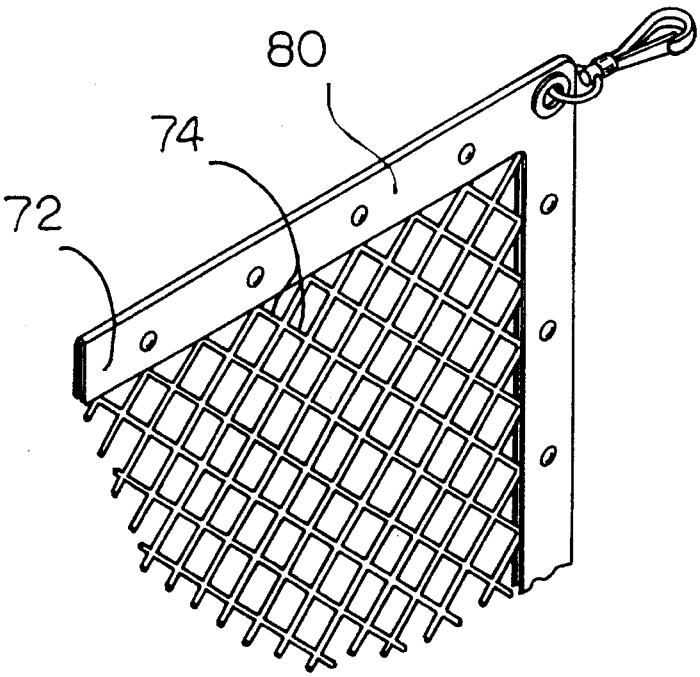
FIG. 5 is an enlarged corner view of a portion of the screen of the prior figures.
Figure 6:
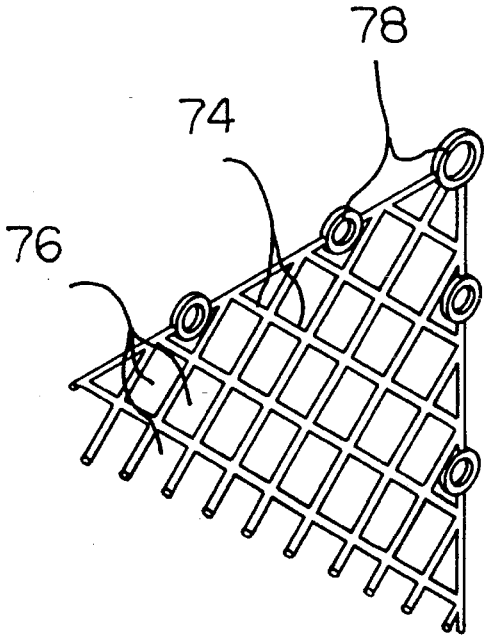
FIG. 6 is an enlarged showing of the screen material of FIGS. 1, 2 and 6.

With reference now to the drawings, and in particular to FIG. 1 thereof, the preferred embodiment of the new and improved portable fence with water filled bases embodying the principles and concepts of the present invention and generally designated by the reference numeral 10 will be described.

The invention, the new and improved portable fence with water filled bases is a system 10 comprised of a plurality of components. In their broadest context, such components include corner posts, bases, fence panels, and fasteners. Such components are specifically configured and correlated with respect to each other so as to attain the desired objective.

More specifically, the key element of the system 10 of the present invention are a plurality of corner posts 12. Such posts are preferably positioned in a rectangular array as shown in FIG. 1. Other arrays are of course possible. Each corner posts 12 include a cylindrical tube 14 positionable in a vertical orientation. Each tube has a lower end 16 and an upper end 18. A cap 20 with a closed top 22 is positionable over the upper end.

In association with the tubes are a like number of extension members 26. The extension members are positioned over the lower end of each tube. Each extension member is cylindrical in configuration with an internal shoulder 28. Such shoulder is adapted to receive thereagainst the lower end of an associated tube. The upper cap and lower extension member are formed with outwardly extending rings 30 and 32. The rings are adapted to support the corners of a screen as will be described hereinafter.

Coupling between the extension member and bases, to be described later is effected through the lower end of the base being uniquely configured. Such configuration includes upwardly extending recesses 36. The recesses thus form therebetween springs 38 in the form of tangs between the recesses.

Beneath each corner posts and tube is a base 42. The plurality of bases are positioned beneath the plurality of corner posts. Each base is adapted to receive the lower end of an extension member. The bases are positionable in a rectangular array beneath the posts and extension members. Note again FIG. 1.

Each base includes a lower planar surface 46 and a generally hemispherical upper surface 48. A vertical recess 50 is formed to extend downwardly from the upper surface for the receipt of the lower end of the extension member. The lower end of the extension member is formed with an annular projection 52. Corresponding therewith, the lower end of the recess is formed with an annular groove 54. Such groove is for removably receiving the annular projection. This relationship is for removably coupling in a secure manner the base and annular projection.

A threaded aperture 58 is formed in the hemispherical upper surface. In association therewith, a threaded plug 60 is removably secured. The purpose of the aperture is for filling the base with water for added weight and security during operation and use.

Greater security is provided through a plurality of supplemental apertures 64. Such supplemental apertures extend through the base in a region constituting an annular flange 66 formed as a radial extension from the lower surface of the base. Such supplemental apertures are for receiving anchor pins 68 this allows for greater securement of the bases and posts with respect to the ground at locations where they are to be coupled.

The next major component of the system 10 includes a plurality of rectangular fence panels 72. Each fence panel is formed of a flexible fencing material 74. Rectangular apertures 76 extend therethrough. In addition, a plurality of circular grommets 78 are formed integrally with the periphery of the fencing material. Thereover, a plastic edging 80 is secured around a periphery of the fence on opposite sides of the fence material.

The posts, extension members, bases and mesh material as well as the edging are preferably fabricated of a lightweight plastic material. Weight is provided through the water and further securement through pins.

The last component of the system is a plurality of fasteners 84. Each fastener is secured to a corner of a fence panel. Such fasteners are for removable securement of the fence panels with the apertures of the rings of the extension member and cap of each tube.

The uses of the present invention include protecting a yard during garage sales, keeping balls from entering the street while children play, sectioning off construction sites and an added barrier for athletic fields.

The advantage of the present invention include, that it is totally portable, reusable, of simple construction, has variations of construction, and pieces can be sold separately and added as desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable fence with water filled bases comprising, in combination:

a plurality of corner posts positionable in a rectangular array, each corner post including a cylindrical tube positionable in a vertical orientation, each tube having a lower end and an upper end with a cap with a closed top positionable over the upper end and an extension member positioned over the lower end, the extension member being cylindrical in configuration with an internal shoulder adapted to receive thereagainst the lower end of the tube, the upper cap and lower extension member being formed with outwardly extending rings adapted to support corners of a screen, the lower end of the extension member being formed with upwardly extending recesses for forming spring urged tangs therebetween;

a plurality of bases, each base adapted to receive the lower end of the extension member and positionable in a rectangular array beneath the posts and extension members, each base including a planar lower surface and a generally hemispherical upper surface with a vertical recess formed to extend downwardly from the upper surface for the receipt of the lower end of the extension member, the lower end of the extension member being formed with an annular projection with the lower end of the recess being formed with an annular groove for receiving the annular projection for the secure coupling therebetween, and a threaded aperture with a threaded plug formed in the hemispherical portion of the base for filling the base with water during operation and use, and a plurality of apertures extending through the base constituting an annular flange formed as an extension of the lower surface for receiving anchor pins for greater securement of the bases and posts with respect to the ground;

a plurality of rectangular fence panels, each fence panel being formed of a flexible plastic fencing material with rectangular apertures therethrough and with a plurality of circular grommets formed integrally with the periphery thereof, and a plastic edging around the periphery of the fence on opposite sides of the fence material;

the posts, extension members, bases and mesh material being fabricated of a lightweight plastic material; and a fastener formed in each corner of each panel for removably coupling with the apertures in the panels and the rings of each tube.

2. A portable fence with water filled bases comprising:

a plurality of corner posts positionable in a rectangular array, each corner post including a cylindrical tube positionable in a vertical orientation, each tube having a lower end and an upper end with a cap with a closed top positionable over the upper end and an extension member positioned over the lower end, the extension member being cylindrical in configuration with an internal shoulder adapted to receive thereagainst the lower end of the tube, the upper cap and lower extension member being formed with outwardly extending rings adapted to support corners of a screen, the lower end of the extension member being formed with upwardly extending recesses for forming spring urged tangs therebetween; and a plurality of bases, each base adapted to receive the lower end of the extension member and positionable in a rectangular array beneath the posts and extension members, each base including a planar lower surface and a generally hemispherical upper surface with a vertical recess formed to extend downwardly from the upper surface for the receipt of the lower end of the extension member, the lower end of the extension member being formed with an annular projection with the lower end of the recess being formed with an annular groove for receiving the annular projection for the secure coupling therebetween, and a threaded aperture with a threaded plug formed in the hemispherical portion of the base for filling the base with water during operation and use, and a plurality of apertures extending through the base constituting an annular flange formed as an extension of the lower surface for receiving anchor pins for greater securement of the bases and posts with respect to the ground.

3. The device as set forth in claim 2 and further including:

a plurality of rectangular fence panels, each fence panel being formed of a flexible plastic fencing material with rectangular apertures therethrough and with a plurality of circular grommets formed integrally with the periphery thereof, and a plastic edging around the periphery of the fence on opposite sides of the fence material; and the posts, extension members, bases and mesh material being fabricated of a lightweight plastic material.

4. The device as set forth in claim 3 and further including:

a fastener formed in each corner of each panel for removably coupling with the apertures in the panels and the rings of each tube.

* * * * *